US009655435B2

(12) United States Patent
Kraemer et al.

(10) Patent No.: US 9,655,435 B2
(45) Date of Patent: May 23, 2017

(54) TOOTHBRUSH BRISTLE ARRANGEMENT

(75) Inventors: Hans Kraemer, Buehl (DE); Claudia Dahlkoetter, Buehl (DE)

(73) Assignee: GlaxoSmithKline Consumer Healthcare GmbH & Co., KG, Buehl (DE)

( * ) Notice: Subject to any disclaimer, the term of this patent is extended or adjusted under 35 U.S.C. 154(b) by 1167 days.

(21) Appl. No.: 12/636,352

(22) Filed: Dec. 11, 2009

(65) Prior Publication Data

US 2010/0223745 A1 Sep. 9, 2010

(30) Foreign Application Priority Data

Dec. 15, 2008 (GB) ..... 0822820.7
Jan. 30, 2009 (GB) ..... 0901582.7

(51) Int. Cl.

| | |
|---|---|
| ***A46B 9/04*** | (2006.01) |
| ***A46B 9/02*** | (2006.01) |
| ***A46B 9/06*** | (2006.01) |
| ***A46D 1/00*** | (2006.01) |

(52) U.S. Cl.

CPC ..... *A46B 9/04* (2013.01); *A46B 9/02* (2013.01); *A46B 9/025* (2013.01); *A46B 9/028* (2013.01); *A46B 9/06* (2013.01); *A46D 1/00* (2013.01); *A46D 1/0276* (2013.01); *A46B 2200/1066* (2013.01)

(58) Field of Classification Search

CPC ... A46B 2200/1066; A46B 9/04; A46B 9/045; A46B 9/065

USPC ..... 15/167.1, 191.1, 207.2

See application file for complete search history.

(56) References Cited

U.S. PATENT DOCUMENTS

| | | | | |
|---|---|---|---|---|
| 4,724,569 | A * | 2/1988 | Eguchi et al. | 15/167.1 |
| D443,985 | S | 6/2001 | Beals et al. | |
| 6,308,367 | B1 | 10/2001 | Beals et al. | |
| 6,322,152 | B2 | 11/2001 | Trojanowski et al. | |
| 6,546,586 | B2 * | 4/2003 | Cho | 15/167.1 |
| 2002/0162183 | A1 | 11/2002 | Cho | |
| 2005/0039279 | A1 | 2/2005 | Koeth et al. | |
| 2006/0096053 | A1 | 5/2006 | Fischer et al. | |
| 2006/0236478 | A1 | 10/2006 | Hohlbein et al. | |
| 2007/0010525 | A1 | 1/2007 | Jackson | |
| 2007/0101525 | A1 * | 5/2007 | Hohlbein | 15/106 |
| 2008/0184511 | A1 | 8/2008 | Brown et al. | |
| 2008/0271276 | A1 * | 11/2008 | Garberg et al. | 15/167.1 |
| 2009/0000903 | A1 | 1/2009 | Yazaki et al. | |

FOREIGN PATENT DOCUMENTS

| | | |
|---|---|---|
| AR | 014394 | 11/1998 |
| DE | 35 28 596 | 2/1987 |
| EP | 0 336 641 | 10/1989 |
| EP | 0 596 633 | 5/1994 |

(Continued)

*Primary Examiner* — Todd E Manahan
*Assistant Examiner* — Brianne Kalach
(74) *Attorney, Agent, or Firm* — Joshua D. Sanders

(57) ABSTRACT

A toothbrush head with bristles comprising tapered and non-tapered bristles, in which the non-tapered bristles extend to two different lengths from the face, being a first greater length $LN^1$ and a second shorter length $LN^2$. In a preferred embodiment non-tapered bristles are combined with tapered bristles in tufts which are inclined in opposite directions away from and towards the grip handle.

18 Claims, 9 Drawing Sheets

(56) References Cited

FOREIGN PATENT DOCUMENTS

| | | |
|---|---|---|
| EP | 1 234 525 | 8/2002 |
| EP | 1 415 572 | 5/2004 |
| EP | 1 425 989 B | 6/2004 |
| JP | 3059451 | 12/1991 |
| JP | 11-075939 | 3/1999 |
| JP | 2001-507981 | 2/2006 |
| MX | 2009/013951 | 3/2010 |
| WO | WO96/16571 | 6/1996 |
| WO | WO97/07707 | 3/1997 |
| WO | WO97/24949 | 7/1997 |
| WO | WO97/42853 | 11/1997 |
| WO | WO97/42854 | 11/1997 |
| WO | WO98/37788 | 9/1998 |
| WO | WO9923910 | 5/1999 |
| WO | WO01/32053 | 5/2001 |
| WO | WO01/82741 | 11/2001 |
| WO | WO2009000903 | 12/2008 |

* cited by examiner

-L
L-
W
W
161
162
163
164
165
166
167
1641
1642
1643

-L
L-
W
W
171
172
173
174
175
176
177

TOOTHBRUSH BRISTLE ARRANGEMENT

FIELD OF THE INVENTION

This invention relates to toothbrushes, in particular to the bristle configuration of toothbrush heads. Especially this invention relates to improved toothbrush bristle configurations comprising tapered bristle filaments.

BACKGROUND OF THE INVENTION

Toothbrushes are well known articles generally comprising a head for insertion in the user's mouth and a grip handle to be held during use, with a neck region in between. The toothbrush head normally has a surface, termed herein the "bristle surface" from which bristles extend from a lower end of the bristles closest to the bristle surface to an upper end distant from the bristle surface. Toothbrush bristles are also well known articles, generally comprising a filament of a stiff but flexible material, disposed in tufts of plural filaments extending from the bristle surface. The polyamide Nylon is very frequently used as a toothbrush bristle material.

Although in most toothbrushes the bristle filaments have the same cross-section along their entire length from their lower to their upper end except for the extreme upper end which is end-rounded, it is also known to use tapered bristles which decrease in their cross section toward their upper end in a shallow generally conical sloping profile. Tapered bristles, being thinner at their upper end, have different bending and flexibility characteristics to non-tapered filaments. In particular tapered bristles are known for efficacy in reaching into the spaces between the teeth, the so called "interproximal" spaces. For example such bristles are disclosed in EP-A-1 234 525, EP-A-1 415 572, U.S. Pat. No. 6,546,586, WO-A-97/42853, WO-A-97/42854, WO-A-01/32053, WO-A-01/82741, EP-A-0 596 633 among others.

Particular relative dispositions of the tapered bristles on the bristle surface are also known. For example U.S. Pat. No. 6,546,586 discloses a toothbrush head in which each tuft comprises plural bristle filaments made of polybutylene terephthalate in the form of shorter filaments of uniform cross section and longer filaments which taper toward their upper end. It is known to combine tapering and non-tapering bristles on a toothbrush head, e.g. from US-A-2006/0096053 which discloses a head for an electric toothbrush. It is also known from other disclosures to combine long and short bristle filaments in a tuft e.g. U.S. Pat. No. 3,103,679, WO-A-96/16571 and DE-A-35 28 596.

Generally there are two methods of producing such tapered bristles. One method is to chemically erode the ends of the bristle filaments. The other is to mechanically abrade them to a taper. It has previously been found difficult to accurately mechanically abrade bristle filaments in situ on a toothbrush head, particularly to achieve differences in length between tapered and non-tapered bristles. A known toothbrush of the type disclosed in WO-A-96/16571 is known to have been unsuccessful commercially because of poor mouth feel. However recent new mechanical bristle abrasion technologies have opened up new possibilities for exploring variations in length, inclination, tufting patterns etc. of tapered toothbrush bristles, especially in combination with non-tapered bristles.

It is an object of this invention to explore the possibilities of toothbrush heads with combinations of tapered and non-tapering bristles, especially with the intention of providing an improved toothbrush head incorporating tapered bristle filaments, e.g. providing tooth cleaning, particularly in the interproximal spaces, at the gingival margin, in subgingival access, and also having manufacturing advantages. Other objects and advantages of the invention will be apparent from the following description.

SUMMARY OF THE INVENTION

According to a first aspect of this invention a toothbrush head is provided having a bristle surface from which extend plural tufts of bristles, said bristles being arranged in plural tufts each of which contains plural bristles, said bristles comprising plural tapered bristles and plural non-tapered bristles, characterized in that said non-tapered bristles extend to two different lengths from the face, being a first greater length $LN^1$ and a second shorter length $LN^2$.

BRIEF DESCRIPTION OF THE DRAWINGS

The invention will now be described by way of example only with reference to the accompanying figures.

DETAILED DESCRIPTION OF THE INVENTION

Figure 1:
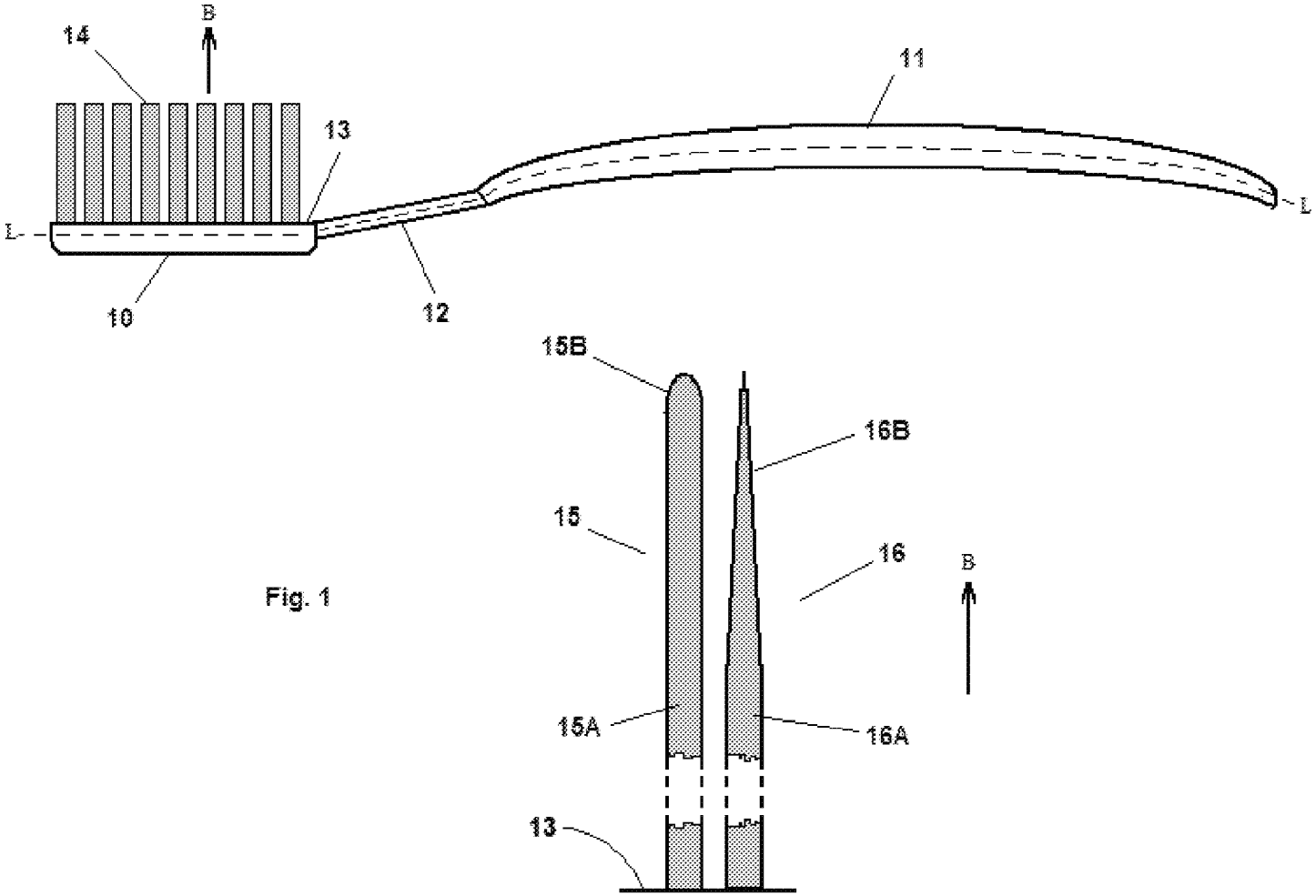
FIG. 1 shows a toothbrush generally.

The term "tapered bristles" is a term of the toothbrush bristle art, a synonym being "pointed bristles" as for example used in US-A-2006/0096053, or "needle shaped bristles" as for example used in EP 1 425 989B. Such "tapered bristles" have a generally conical tapered profile over a substantial part of their length remote from the bristle face, e.g. 10-50% of their length remote from the bristle surface. "Non tapered bristles" are differentiated from such tapered bristles in having a substantially uniform cross section along their length, except that conventionally their extreme ends remote from the bristle surface are rounded to help prevent damage to users' soft tissues by otherwise jagged ends. In the art, bristles which are merely end rounded in this conventional manner are not considered to be "tapered bristles".

In the toothbrush head of this invention the non-tapered bristles may for example extend to substantially only two discrete lengths $LN^1$ and $LN^2$, so that all of the non-tapered bristles are either only substantially of the length $LN^1$ or $LN^2$, with no continuum of lengths of non-tapered bristles between these two lengths.

In the toothbrush head of this invention the tapered bristles may also for example extend to two different lengths from the face, being a first greater length $LT^1$ and a second shorter length $LT^2$. For example such tapered bristles may extend to substantially only two discrete lengths $LT^1$ and $LT^2$, so that all of the tapered bristles are either only substantially of the length $LT^1$ or $LT^2$, with no continuum of lengths of tapered bristles between these two lengths.

The present invention may be realized in various embodiments.

In one embodiment, one or more of the plural tufts may each comprise plural tapered bristles and plural non-tapered bristles in which the non-tapered bristles extend to two different lengths from the face, being a first greater length $LN^1$ and a second shorter length $LN^2$.

In this embodiment, in such one or more tuft, the tapered bristles may all be of substantially the same length LT, which may be longer than the first greater length $LN^1$ of the non-tapered bristles. Alternatively in this embodiment, within such one or more tuft, the tapered bristles may be of two or more respectively greater and shorter lengths $LT^1$ and $LT^2$, and both $LT^1$ and $LT^2$ may be greater than the first greater length $LN^1$ of the non-tapered bristles.

In another embodiment the tufts on the bristle surface comprises tufts which contain the non-tapered bristles, and in such tufts the non-tapered bristles extend to the two different lengths from the face, being the first greater length $LN^1$ and the second shorter length $LN^2$, and the tapered bristles are contained in tufts discrete from these. Such tufts which contain tapered bristles may contain only tapered bristles.

In this embodiment, in tufts containing tapered bristles the tapered bristles may all be of substantially the same length LT, which may be longer than the first greater length $LN^1$ of the non-tapered bristles. Alternatively in this embodiment, within such one or more tuft containing tapered bristles, the tapered bristles may be of two or more respectively greater and shorter lengths $LT^1$ and $LT^2$, and both $LT^1$ and $LT^2$ may be greater than the first greater length $LN^1$ of the non-tapered bristles.

In another embodiment the tufts on the bristle surface comprises tufts which contain the non-tapered bristles being only of the first greater length $LN^1$, and tufts which contain non-tapered bristles being only of the second shorter length $LN^2$, and the tapered bristles are contained in tufts discrete from these tufts containing non-tapered bristles.

In this embodiment, in tufts containing tapered bristles the tapered bristles may all be of substantially the same length LT, which may be longer than the first greater length $LN^1$ of the non-tapered bristles. Alternatively in this embodiment, within such one or more such tuft, the tapered bristles may be of two or more respectively greater and shorter lengths $LT^1$ and $LT^2$, and both $LT^1$ and $LT^2$ may be greater than the first greater length $LN^1$ of the non-tapered bristles.

In these latter two embodiments one or more tufts containing non-tapered bristles may alternate longitudinally with one or more tufts containing tapered bristles. In the last-mentioned embodiment one or more tufts which contain non-tapered bristles of the first greater length $LN^1$, may alternate longitudinally with one or more tufts which contain the non-tapered bristles of the second shorter length $LN^2$.

In another embodiment the tufts on the bristle surface comprise tufts which contain non-tapered bristles being of the first greater length $LN^1$, and tufts which contain non-tapered bristles of the second shorter length $LN^2$, and such tufts may also contain tapered bristles.

For example in this last embodiment only the tufts which contain non-tapered bristles of the first greater length $LN^1$ may also contain the tapered bristles. Alternatively only the tufts which contain the non-tapered bristles of the second shorter length $LN^2$ may also contain the tapered bristles. Alternatively both the tufts which contain non-tapered bristles of the first greater length $LN^1$ and the tufts which contain the non-tapered bristles of the second shorter length $LN^2$, may also contain the tapered bristles.

For example in this last embodiment the tapered bristles may all be of substantially the same length LT, which may be longer than the first greater length $LN^1$ of the non-tapered bristles. Alternatively in this embodiment, the tapered bristles may be of two or more respectively greater and shorter lengths and such greater and shorter lengths may both be greater than the first greater length $LN^1$ of the non-tapered bristles. Alternatively in this embodiment the tapered bristles may be of two or more respectively greater and shorter lengths $LT^1$ and $LT^2$, and both $LT^1$ and $LT^2$ may be greater than the first greater length $LN^1$ of the non-tapered bristles. For example the difference between $LT^1$ and $LT^2$ may correspond to the difference between $LN^1$ and $LN^2$.

According to a second aspect of this invention a toothbrush head is provided, being connected to or connectable to a toothbrush grip handle to thereby define a head-grip handle longitudinal direction, the head being elongate in the longitudinal direction and having a width direction across the head perpendicular to the longitudinal direction, the head having a bristle surface from which plural tufts of bristles extend, the plural bristle tufts comprising;

at least one first tuft which is inclined in a direction having a longitudinal component at 75-85° to the bristle surface such that the ends of the bristles remote from the bristle surface are longitudinally further from the handle than the ends closest to the bristle surface, at least one second tuft, widthways distanced from the first tuft, the second tuft being inclined in a direction having a longitudinal component at 75-85° to the bristle surface such that the ends of the bristles remote from the bristle surface are longitudinally closer to the handle than the ends closest to the bristle surface, wherein in that at least one first tuft and/or at least one second tuft comprises tapered bristles, and wherein the plural first tufts comprise first tufts having a greater length and first tufts having a lesser length, and the plural second tufts may comprise second tufts having a greater length and second tufts having a lesser length.

In this aspect preferably there are plural first tufts arranged along a line extending with a longitudinal direction component along the bristle surface, and plural second tufts arranged along a line extending with a longitudinal direction component along the bristle surface, the line of first tufts being widthways distanced from the line of second tufts. Such a line may be parallel to the longitudinal direction, at an acute angle to the longitudinal direction, curved, zig-zag or sinuous. Across the width of the toothbrush head there may be plural such pairs of lines of first and second tufts.

In this aspect the respective greater lengths may be the same. The respective lesser lengths may be the same. In this embodiment the greater length of the first and second tufts may be the same, and the lesser length of the first and second tufts may be the same.

In this aspect, in a line of first tufts, individual tufts of the greater length may alternate longitudinally with tufts of the lesser length. Similarly in a line of second tufts, individual tufts of the greater length may alternate longitudinally with tufts of the lesser length. Alternatively, in a line of tufts, individual tufts of the greater or lesser length may alternate longitudinally with two or more tufts of respectively the lesser or greater length. Alternatively, in a line of tufts, two or more tufts of the greater or lesser length may alternate longitudinally with two or more tufts of respectively the lesser or greater length. In this embodiment suitably the length of the tapered bristles is greater than the lesser length of the first and second tufts, preferably greater than the greater length of the first and second tufts.

In this aspect preferably the angle of inclination is 78-82° to the bristle surface. Preferably all of the tufts are inclined at the same acute angle of inclination to the bristle surface, although first and second tufts are inclined in opposite directions.

In a third aspect of this invention the toothbrush head has a bristle surface from which plural tufts of bristles extend, the plural bristle tufts comprising;

at least one first tuft which is inclined in a direction having a longitudinal component at 75-85° to the bristle surface such that the ends of the bristles remote from the bristle surface are longitudinally further from the handle than the ends closest to the bristle surface, at least one second tuft, widthways distanced from the first tuft, the second tuft being inclined in a direction having a longitudinal component at 75-85° to the bristle surface such that the ends of the bristles remote from the bristle surface are longitudinally closer to the handle than the ends closest to the bristle surface, the plural first tufts comprise tufts comprising non-tapered bristles having a greater length $LN^1$ and tufts comprising non-tapered bristles having a lesser length $LN^2$, and at least one first tuft and/or at least one second tuft also comprises tapered bristles.

In this aspect the respective greater lengths $LN^1$ of non-tapered bristles in first and second tufts may be the same. In this embodiment the respective lesser lengths $LN^2$ of non-tapered bristles in the first and second tufts may be the same.

In this aspect individual first tufts including non-tapered bristles of the greater length $LN^1$ may alternate longitudinally with first tufts including non-tapered bristles of the lesser length $LN^2$. Similarly in a line of second tufts, individual second tufts including non-tapered bristles of the greater length $LN^1$ may alternate longitudinally with second tufts including non-tapered bristles of the lesser length $LN^2$.

Alternatively individual first tufts including non-tapered bristles of the greater length $LN^1$ or lesser length $LN^2$ may alternate longitudinally with two or more tufts including non-tapered bristles of respectively the lesser or greater length.

Alternatively, two or more tufts including non-tapered bristles of the greater $LN^1$ or lesser $LN^2$ length may alternate longitudinally with two or more tufts including non-tapered bristles of respectively the lesser length $LN^2$ or greater length $LN^1$.

In this aspect suitably the length LT of the tapered bristles is greater than the lesser length $LN^2$ of the non-tapered bristles preferably greater than the greater length $LN^1$ of the non-tapered bristles.

In an embodiment longer tapering bristles and shorter tapering bristles differ in length by 7 mm or less, e.g. 4 mm or less, for example 2 to 4 mm.

Typically the length to which the shorter tapering bristles extend from the bristle surface is 9+/−1 mm and the length to which the shorter tapering bristles extend from the bristle surface is 13+/−1 mm.

Typically the tapering bristles may be circular in cross section, typically 0.1-0.25 mm, e.g. 0.15-0.20 mm, at maximum. This is a typical standard dimension for toothbrush bristle filaments. In one construction each tuft may contain 2-12 longer tapering bristles, and 20-30 shorter tapering bristles.

It has been found that in a tuft which contains both non-tapering and tapering bristles, 5-7 tapering bristles and 26-28 non-tapering bristles in the tuft is a suitable number for an optimized effect.

It is found that this range of numbers of longer and shorter tapering bristles in the tufts can be advantageous in providing an acceptable mouth feel and in getting the longer bristles in between the teeth. Too few longer bristles may not feel comfortable to the user, too many and it may not be easy to get a larger number of the longer bristles between the teeth.

The longer and shorter tapering bristles may be disposed within tufts in various ways. For example the longer bristles may be disposed predominantly about the central longitudinal axis of the tuft. For example alternatively the longer bristles may be disposed essentially randomly within the tuft.

In the toothbrush head of this invention the tufts comprising tapering bristles may be disposed in various ways on the bristle surface of the head. For example all of the tufts on the toothbrush head may comprise such tufts, and may be disposed in a conventional pattern on the bristle surface. For example such tufts may be disposed in a pattern on the bristle surface of the head in combination with tufts comprising only non-tapered bristles.

Typically the tapering bristles may be made of polyamide, e.g. Nylon, particularly the material Tynex™. This is inter-alia due to the current state of optimization of available machines capable of abrading the ends of bristle filaments to a tapering profile, and the properties of such bristle filament materials as Tynex™.

In a preferred process, the toothbrush head of this invention may be made by a process in which the bristles which are to become tapered bristles are first fixed into the face and the upper ends of the bristles are then mechanically abraded into a tapered shape. Machines able to do such mechanical abrasion are known in the toothbrush manufacturing art.

This fixing may for example be by insertion into tuft socket holes in the face, or by the so-called "anchorless" process in which the bristles are fixed into the hot fluid plastics material of the head during the injection moulding process in which the head is made.

Alternatively bristle filaments may be purchased in an already tapered form. There are two main types of such commercially available tapering bristle filaments.

Double ended bristle filaments are tapered at both ends and are normally mounted in a toothbrush bristle surface by folding them in the middle into a "U" shape and setting the folded middle region of the "U" shape in a socket hole in the bristle surface using a conventional "anchor". In the toothbrush heads of this invention the tapering and non-tapering bristle filaments may comprise such double-ended filaments, conventionally folded in a "U" shape with the bend of the "U" inserted into the socket hole and retained therein by a conventional metal anchor. In such a construction each length of "U" shaped filament provides two bristles extending from the bristle surface.

Single ended bristle filaments are tapered at only one end and are normally mounted in a toothbrush bristle surface by folding them close to the non-tapered end into a "J" shape and setting the folded end region of the "J" shape in a socket hole in the bristle surface using a conventional "anchor".

In a further aspect the present invention provides a toothbrush provided with a head as described herein.

The handle and head of the toothbrush of this invention may be made of known materials such as plastics materials and elastomer materials and may incorporate known features. For example the handle may incorporate features which modify the flexibility of the handle, for example the folded region disclosed in EP-A-0336641. For example the connection between the head and handle may be a flexible connection, for example as disclosed in WO-A-97/24949. For example the head of the toothbrush may be divided into flexibly-linked segments for example as disclosed in WO-A-

97/07707. For example the connection between the head and handle may be a flexible connection, and the head of the toothbrush may be divided into flexibly-linked segments for example as disclosed in WO-A-98/37788.

The toothbrush of the invention may be a manual toothbrush, i.e. to be brought into contact with the user's head solely by hand action, or the toothbrush may be a power toothbrush in which the bristles of the head are moved by an electric, e.g. battery powered, motor.

In FIG. 1 a toothbrush is shown generally, comprising a head 10 for insertion in the user's mouth and a grip handle 11 to be held during use, with a neck region 12 in between. The toothbrush 10 has a longitudinal direction L- -L in the head-handle direction, shown by the hatched line. The toothbrush head 10 has a surface 13, termed herein the "bristle surface" from which plural tufts 14 of bristles (shown generally) extend from a lower end closest to the bristle surface to an upper end distant from the bristle surface 13 in a bristle direction B.

FIG. 1 also shows the ends remote from the bristle surface 13 of two bristles 14 in detail. 15 is a non-tapered bristle, and has a generally cylindrical profile for almost all of its length i.e. region 15A, e.g. 95% or more, and the extreme end 15B, ca. 5% or less is rounded in a smooth curved e.g. an ellipsoid. 16 is a tapered bristle, and has a generally cylindrical profile in its region 16A close to the bristle surface 13 and up to ca. 70% or more of its length, but for the extreme part of its length over region 16B distant from the bristle surface, e.g. 30% or less it is tapered in a sharp generally conical point.

Figure 2:
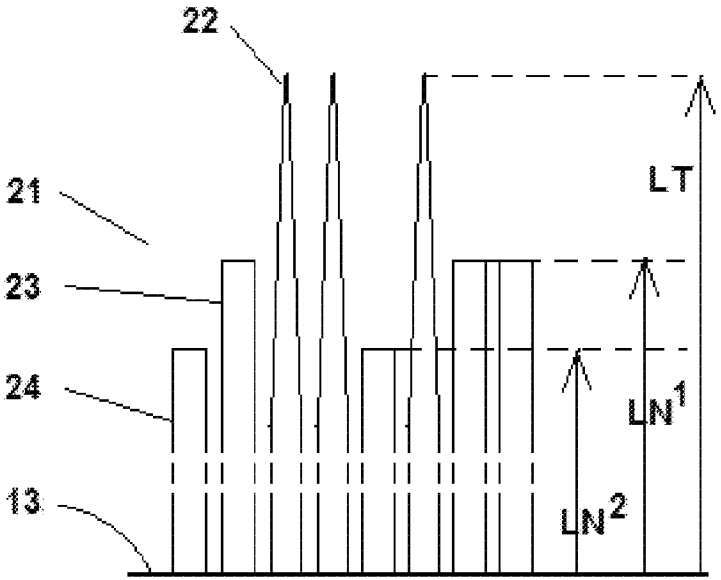

In FIG. 2, the bristle surface of an embodiment of a toothbrush of this invention is shown in a side view. In this embodiment the ends of a single tuft 21 (being a tuft 14 as seen in FIG. 1) of bristles extending from the bristle surface 13 closest to the bristle surface and remotest from the bristle surface are shown in detail. The tuft 21 comprises tapered bristles 22 and plural non-tapered bristles 23, 24. The non-tapered bristles 23, 24 comprise non-tapered bristles 23 of a first greater length $LN^1$ and non-tapered bristles 24 of a second shorter length $LN^2$. All of the non-tapered bristles are either of the first greater length $LN^1$ or the second shorter length $LN^2$. In the embodiment shown in FIG. 2 all of the tapered bristles 22 are all of substantially the same length LT, which is longer than the first greater length $LN^1$ of the non-tapered bristles 23.

Figure 3:
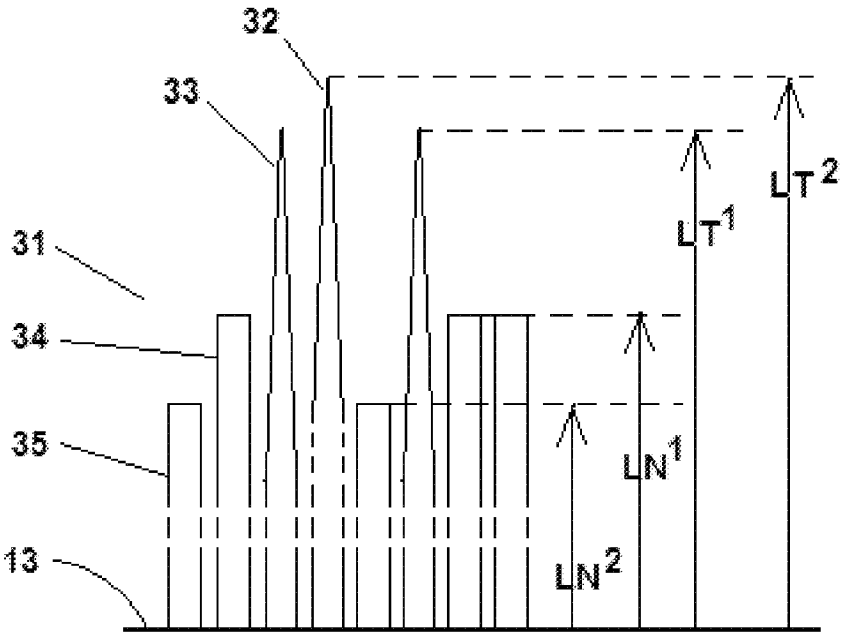
FIGS. 2 to 11 show arrangements of bristles of a toothbrush head of the invention.

In FIG. 3 a variant of the construction illustrated in FIG. 2 is shown. A single tuft 31 (being a tuft 14 as seen in FIG. 1) comprises tapered bristles 32, 33 and plural non-tapered bristles 34, 35. The non-tapered bristles 34, 35 comprise non-tapered bristles 34 of a first greater length $LN^1$ and non-tapered bristles 35 of a second shorter length $LN^2$. Within tuft 31 the tapered bristles 32, 33 are of two respectively greater and shorter lengths $LT^1$ and $LT^2$, and both $LT^1$ and $LT^2$ are greater than the first greater length $LN^1$ of the non-tapered bristles 34. All of the non-tapered bristles are either of the first greater length $LN^1$ or the second shorter length $LN^2$.

Figure 4:
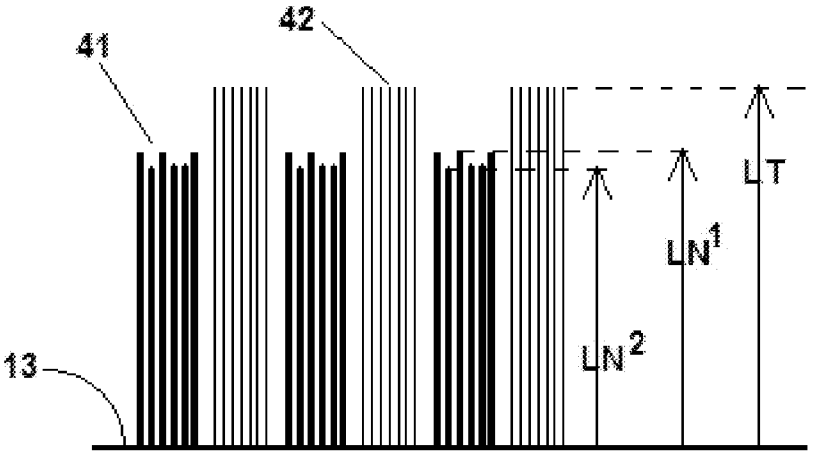

In FIG. 4 the bristle configuration of another embodiment of a toothbrush head of this invention is shown in a side view. In this embodiment plural tufts 41, 42 of bristles are shown extending from bristle surface 13. The tufts 41 contain the non-tapered bristles, and in such tufts 41 the non-tapered bristles extend to the two different lengths from the face, being the first greater length $LN^1$ and the second shorter length $LN^2$. All of the non-tapered bristles are either of the first greater length $LN^1$ or the second shorter length $LN^2$. Tufts 42 containing only tapered bristles are discrete from tufts 41. In the tufts 42 the tapered bristles are all of substantially the same length LT, which is longer than the first greater length $LN^1$ of the non-tapered bristles in tufts 41.

Figure 5:
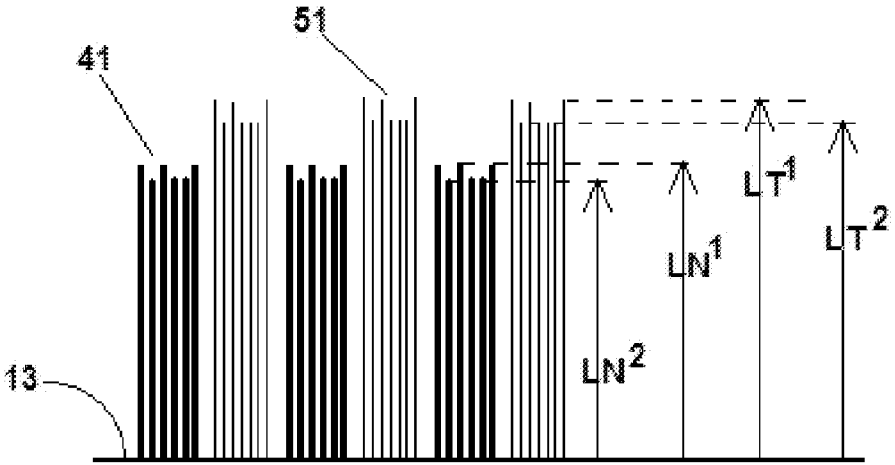

In FIG. 5 a variant of the configuration illustrated in FIG. 4 is shown, parts in common with FIG. 4 being numbered in common. In this variant within the tufts 51 tapered bristles are present having two respectively greater and shorter lengths $LT^1$ and $LT^2$, and both $LT^1$ and $LT^2$ are greater than the first greater length $LN^1$ of the non-tapered bristles in tufts 41. All of the tapered bristles are either of the first greater length $LT^1$ or the second shorter length $LT^2$.

Figure 6:
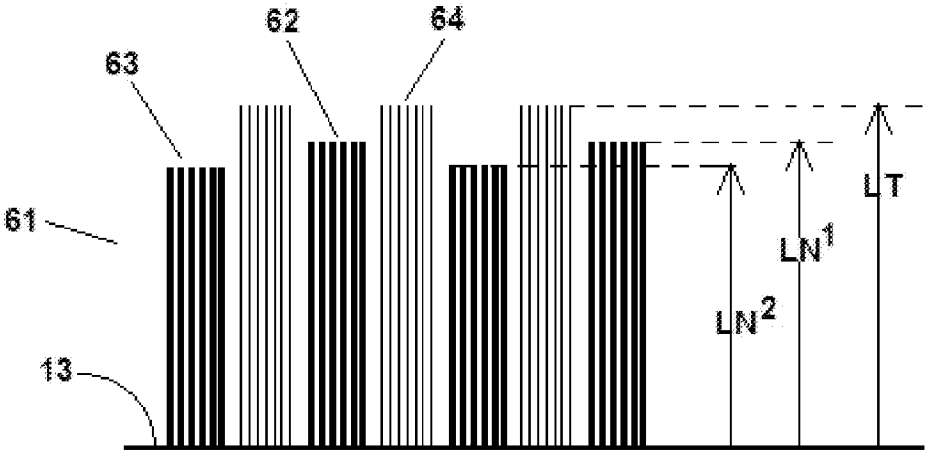

In FIG. 6 the bristle configuration of another embodiment of a toothbrush head of this invention is shown in a side view. In this embodiment the tufts 61 (general) on the bristle surface 13 comprise tufts 62 which contain non-tapered bristles being only of the first greater length $LN^1$ and tufts 63 which contain non-tapered bristles being only of the second shorter length $LN^2$. All of the non-tapered bristles are either of the first greater length $LN^1$ or the second shorter length $LN^2$. Tapered bristles are contained in tufts 64 discrete from these tufts 62 and 63 containing non-tapered bristles. In the tufts 64 containing tapered bristles the tapered bristles are of substantially the same length LT, which is longer than the first greater length $LN^1$ of the non-tapered bristles in the tufts 62. Alternatively (not shown) LT may be the same as or less than the first greater length $LN^1$.

Figure 7:
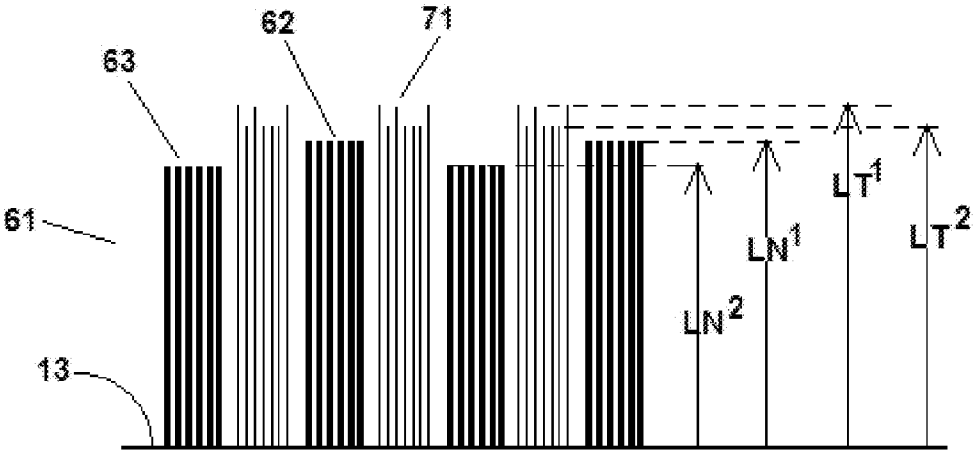

In FIG. 7 a variant of the construction in FIG. 6 is shown, features in common with FIG. 6 being numbered correspondingly. In FIG. 7 within tufts 71 the tapered bristles are of two respectively greater and shorter lengths $LT^1$ and $LT^2$. In this variant both $LT^1$ and $LT^2$ may be greater than the first greater length $LN^1$ of the non-tapered bristles in tufts 63. All of the tapered bristles in tufts 71 are either of the first greater length $LT^1$ or the second shorter length $LT^2$.

In the embodiments of FIGS. 4, 5, 6 and 7 one or more tufts 41, 62, 63 containing non-tapered bristles may alternate longitudinally with one or more tufts 42,51,64,71 containing tapered bristles. For example one or more tufts 62 which contain non-tapered bristles of the first greater length $LN^1$, may alternate longitudinally with one or more tufts 63 which contain the non-tapered bristles of the second shorter length $LN^2$. For example this is shown in FIGS. 6 and 7.

Figure 8:
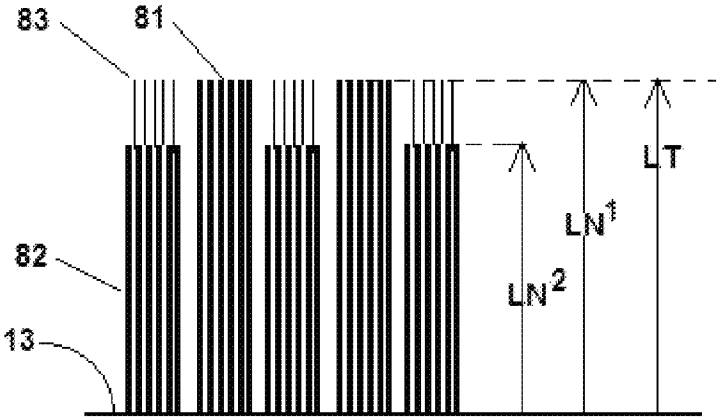

In FIG. 8 the bristle surface 13 of another embodiment of a toothbrush head of this invention is shown in a side view. In this embodiment the tufts on the bristle surface 13 comprise tufts 81 which contain non-tapered bristles being of the first greater length $LN^1$, and tufts 82 which contain non-tapered bristles of the second shorter length $LN^2$. All of the non-tapered bristles are either of the first greater length $LT^1$ or the second shorter length $LT^2$. The tufts 82 also contain tapered bristles 83, all of the same length LT. The length LT is the same as the first greater length $LN^1$.

Figure 9:
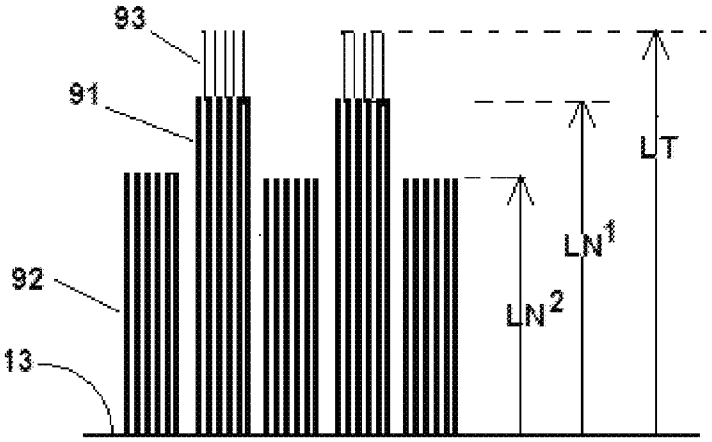

In FIG. 9 the bristle surface 13 of another embodiment of a toothbrush head of this invention is shown in a side view. In this embodiment the tufts on the bristle surface comprise tufts 91 which contain non-tapered bristles being of the first greater length $LN^1$, and tufts 92 which contain non-tapered bristles of the second shorter length $LN^2$. All of the non-tapered bristles are either of the first greater length $LN^1$ or the second shorter length $LN^2$. the tufts 91 also contain tapered bristles 93, all of the same length LT which is longer than $LN^1$.

Figure 10:
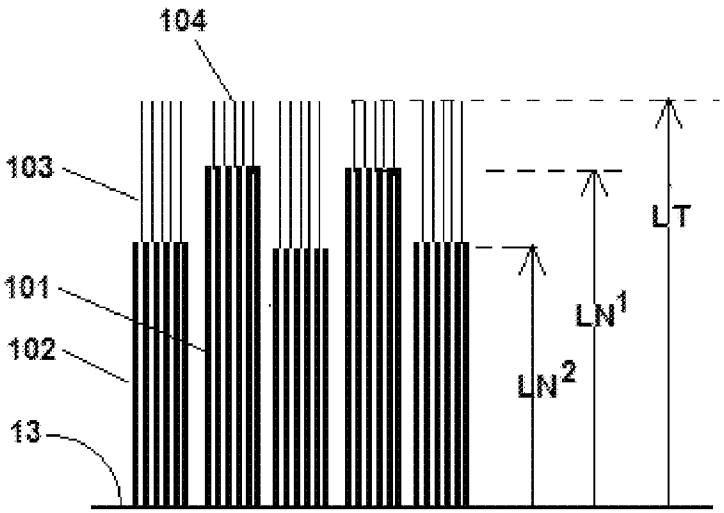

In FIG. 10 the bristle surface 13 of another embodiment of a toothbrush head of this invention is shown in a side view. In this embodiment the tufts on the bristle surface 13 comprise tufts 101 which contain non-tapered bristles being of the first greater length $LN^1$, and tufts 102 which contain non-tapered bristles of the second shorter length $LN^2$. All of the non-tapered bristles are either of the first greater length $LT^1$ or the second shorter length $LT^2$. The both tufts 101 and 102 also contain tapered bristles 103,104, all of the same length LT which is longer than $LN^1$.

Figure 11:
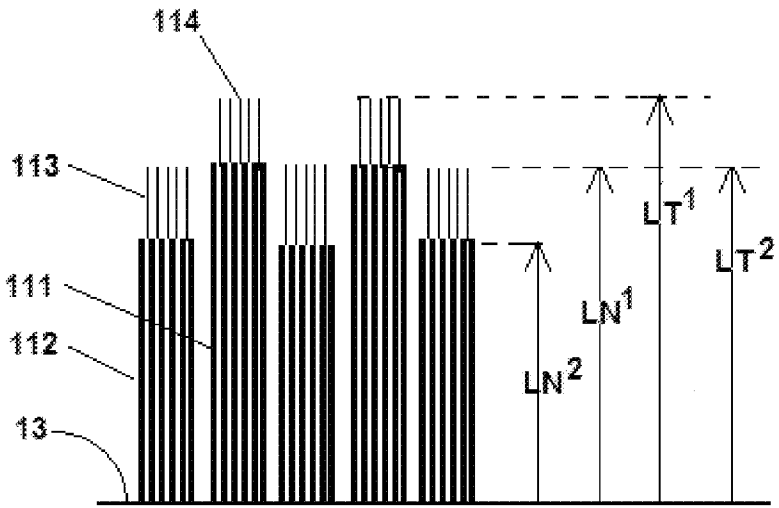

In FIG. 11 the bristle surface 13 of another embodiment of a toothbrush head of this invention is shown in a side view. In this embodiment the tufts on the bristle surface comprise tufts 111 which contain non-tapered bristles being of the first greater length $LN^1$, and tufts 112 which contain non-tapered bristles of the second shorter length $LN^2$. All of the non-tapered bristles are either of the first greater length $LT^1$ or the second shorter length $LT^2$. Tufts 112 contain tapered bristles 113, and the tufts 1111 contain tapered bristles 114. The tapered bristles 113 and 114 are respectively of two different lengths $LT^1$ and $LT^2$, and the difference between $LT^1$ and $LT^2$ corresponds to the difference between $LN^1$ and $LN^2$. All of the tapered bristles are either of the first greater length $LT^1$ or the second shorter length $LT^2$.

In the embodiments of FIGS. 8, 9, 10 and 11 the tufts 81,82; 91,92; 101,102 and 111,112 alternate longitudinally along the bristle surface 13.

FIGS. 12-17 exemplify toothbrush heads of the second and third aspects of this invention.

Figure 12:
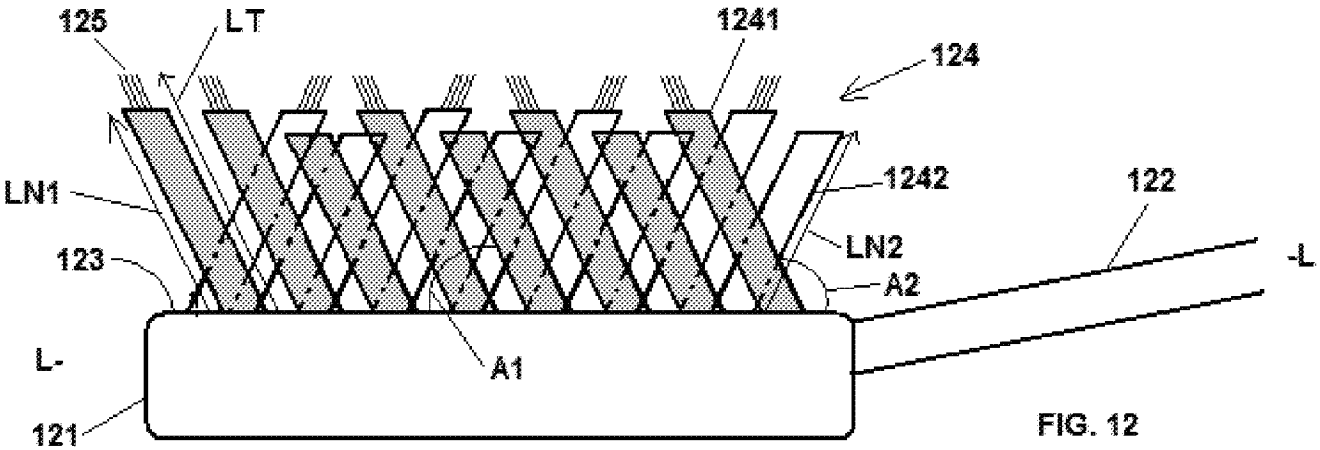
FIGS. 12 to 15 show arrangements of tufts which are inclined at a non perpendicular angle to the bristle surface.

In FIG. 12 a side view of the head 121 and immediately longitudinally adjacent part of the neck 122 of a toothbrush of this invention is shown, looking in the width direction. Neck 122 connects the head 121 integrally to a grip handle (not shown). From bristle surface 123 extend plural tufts of bristles 124 overall. The plural bristle tufts 124 comprise plural first tufts 1241 inclined in a direction having a longitudinal component at an acute angle "A1" 75-85° to the bristle surface such that the ends of the bristles 1241 remote from the bristle surface 123 are longitudinally further from the handle than the ends closest to the bristle surface 123. The tufts 124 further comprise plural second tufts 1242, widthways distanced from the first tufts 1241, the second tufts 1242 also being inclined in a direction having a longitudinal component at acute angle "A2" 75-85° to the bristle surface such that the ends of the bristles remote from the bristle surface 123 are longitudinally closer to the handle than the ends closest to the bristle surface 123.

The first tufts 1241 and second tufts 1242 are arranged in respective lines extending with a longitudinal direction component along the bristle surface 123. Such an arrangement is more clearly shown in the plan view FIG. 13 which shows the direction in which the tufts 1241, 1242 incline.

As seen in FIG. 12 the plural first tufts 1241 and second tufts 1242 comprise tufts containing non-tapered bristles having a greater length $LN^1$ and tufts containing non-tapered bristles having a lesser length $LN^2$. The respective greater lengths of tufts $LN^1$ are the same, and the respective lesser lengths $LN^2$ are the same.

The first and second tufts 1241 and 1242 which contain non-tapered bristles of the greater length $LN^1$ also comprise tapered bristles 125 and these tapered bristles have a length LT greater than the length $LN^1$ of the non tapered bristles therein such that the tapered bristles 125 extend beyond the ends of the non-tapered bristles therein.

As shown in FIG. 12 individual tufts of the greater length $LN^1$ alternate longitudinally with tufts of the lesser length $LN^2$.

Longitudinally between the tufts 1241, 1242 of greater length $LN^1$ which contain tapered bristles 125 are shorter tufts of length $LN^2$ which do not contain tapered bristles but only non-tapered bristles.

Figure 13:
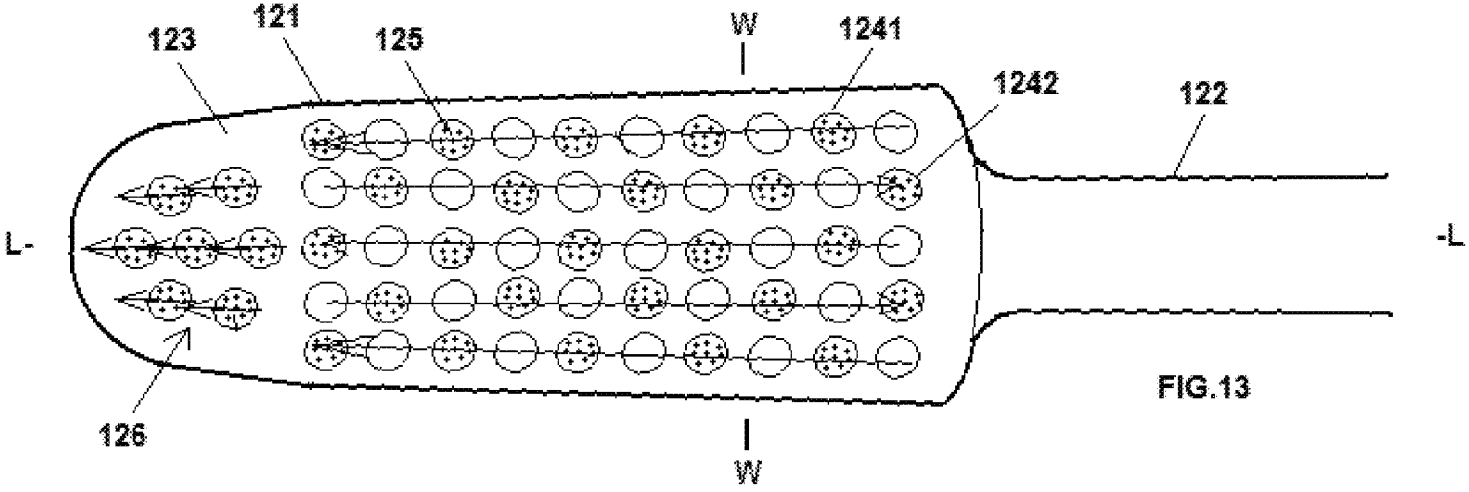

In the construction shown in FIG. 13, adjacent the end of the head 121 furthest from the handle neck 122 is a cluster of plural tufts 126 which are inclined in the direction indicated by the arrow, i.e. the same direction as the first tufts 1241. These tufts 126 comprise non-tapered tufts of the same length as the non-tapered bristles in tufts 1241, and tapered bristles which have a length greater than the length of the non tapered bristles therein such that the tapered bristles extend beyond the ends of the non-tapered bristles in tufts 126.

Figure 14:
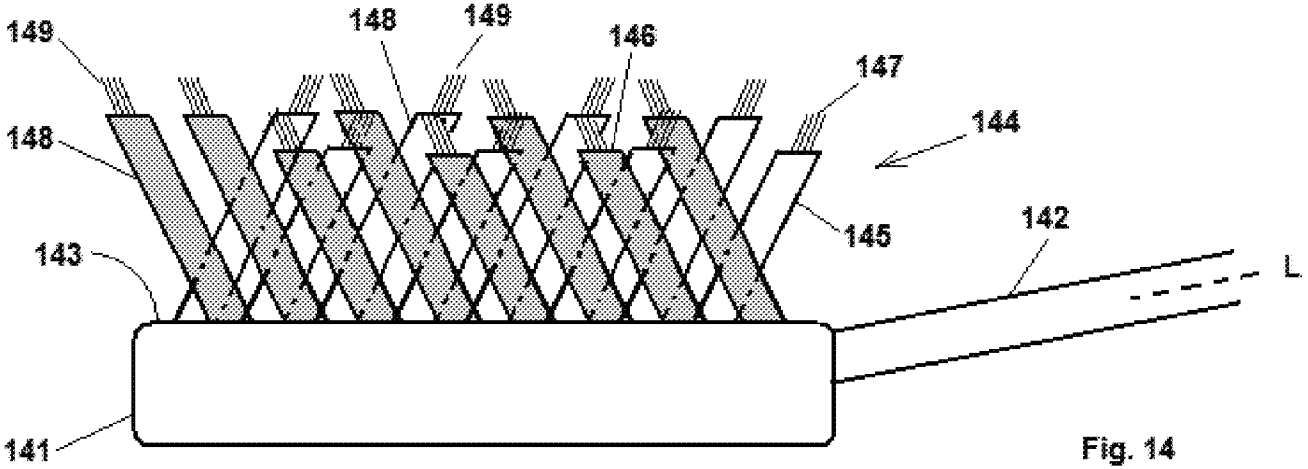

Referring to FIG. 14 this shows another embodiment of this invention in a view analogous to FIG. 12. FIG. 14 shows a side view of the head 141 and immediately longitudinally adjacent part of the neck 142 which connects the head 141 integrally to a grip handle (not shown), looking in the width direction. From bristle surface 143 extend plural tufts of bristles 144 overall. The arrangement of the plural bristle tufts 144 is analogous to those 124 shown in FIG. 12, but in the arrangement shown in FIG. 14 tufts 145, 146 being of the lesser length also include tapered bristles 147 and non-tapered bristles, the length of the tapered bristles 145 being greater than the length of the non-tapered bristles therein. Tufts 148 of the greater length also include tapered bristles 149 and non-tapered bristles, the length of the tapered bristles 149 being greater than the length of the non-tapered bristles therein.

Figure 15:
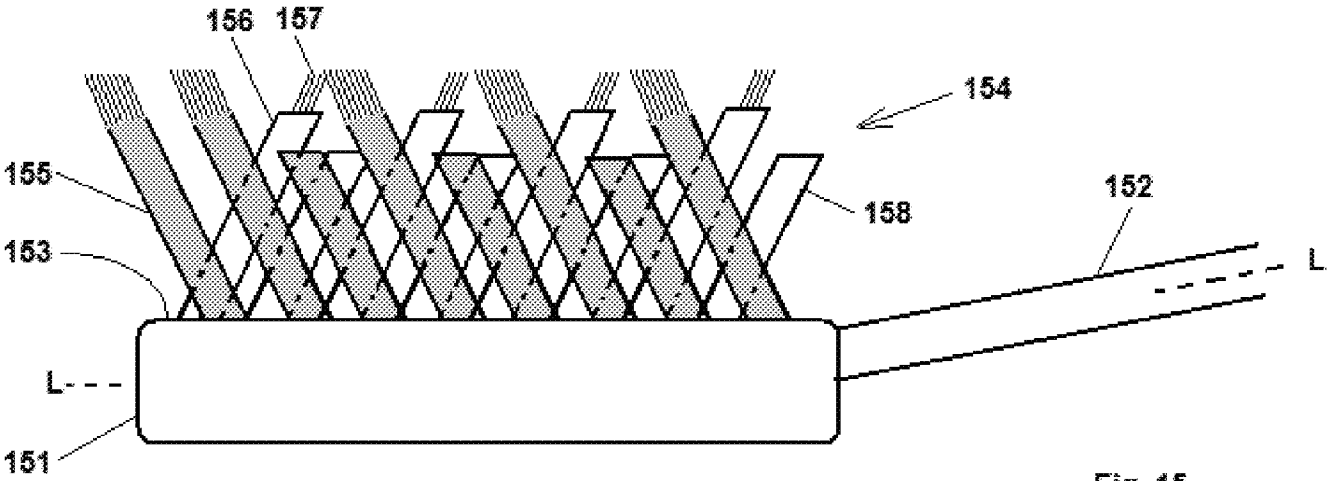

Referring to FIG. 15 this shows another embodiment of this invention in a view analogous to FIG. 14. FIG. 15 shows a side view of the head 151 and immediately longitudinally adjacent part of the neck 152 which integrally joins the head to the grip handle (not shown), looking in the width direction. From bristle surface 153 extend plural tufts of bristles 154 overall. The arrangement of the plural bristle tufts 154 is analogous to those 124 shown in FIG. 12, but in the arrangement shown in FIG. 15 the first tufts 155 being of the greater length consist entirely of tapered bristles having the greater length. Second tufts 156 having the greater length comprise both non-tapered bristles and tapered bristles 157, the tapered bristles 157 being longer than the non-tapered bristles in the tufts 156. Tufts 158 of a lesser length than the tufts 155, 156 comprise only non-tapered bristles.

Figure 16:
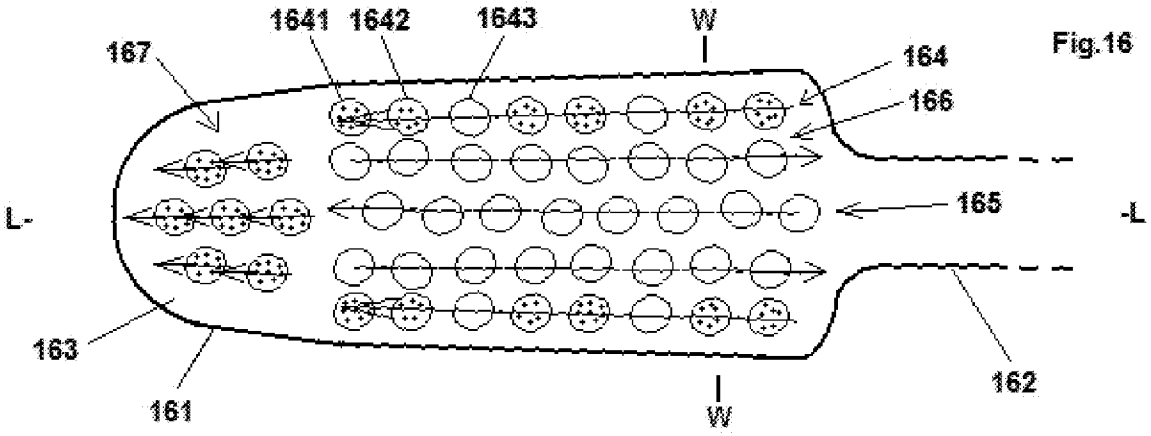
FIG. 16 shows a plan view of a toothbrush head.

Referring to FIG. 16 this shows a plan view of a toothbrush head 161 and part of the immediately adjacent neck 162 which connects the head 161 integrally to the grip handle (not shown), looking down on the bristle surface 163 in a direction perpendicular to the longitudinal direction L-L and the width direction W-W. In an arrangement similar to FIG. 13, a pattern of first tufts 164, 165 and second tufts 166 (generally) extend from the bristle surface 14, and arrows indicate the respective directions of inclination of the tufts 164, 165, 166. In FIG. 16 pairs of first tufts 1641,1642 which include tapered bristles and non tapered bristles, and in which the tapered bristles are longer than the non-tapered bristles, longitudinally alternate in a line with individual first tufts 1643 which consist only of non-tapered bristles. In the tufts 164,165,166 there are tufts which are respectively of greater and lesser length, e.g. analogously to the constructions of FIGS. 12-15 above. In this arrangement the second tufts 165 and a further line of first tufts 166 consist entirely of non-tapered bristles. In this arrangement therefore, only the lines 164 of first tufts which are widthways outermost in the pattern of tufts 164,165,166 on the bristle surface 163 include tapered bristles.

Analogous to FIG. 13, adjacent the end of the head 161 furthest from the handle 162 is a cluster of tufts 167 of the greater length, which lean in the direction of the first tufts 164,165, and which comprise non-tapered bristles and tapered bristles, the tapered bristles in these tufts 167 being longer than the non-tapered bristles.

It will be immediately apparent to those skilled in the art that tufts containing tapered bristles may be provided only in the widthways outermost lines of tufts can be provided in other dispositions of tapered bristles e.g. as shown in FIGS. 12-15.

Figure 17:
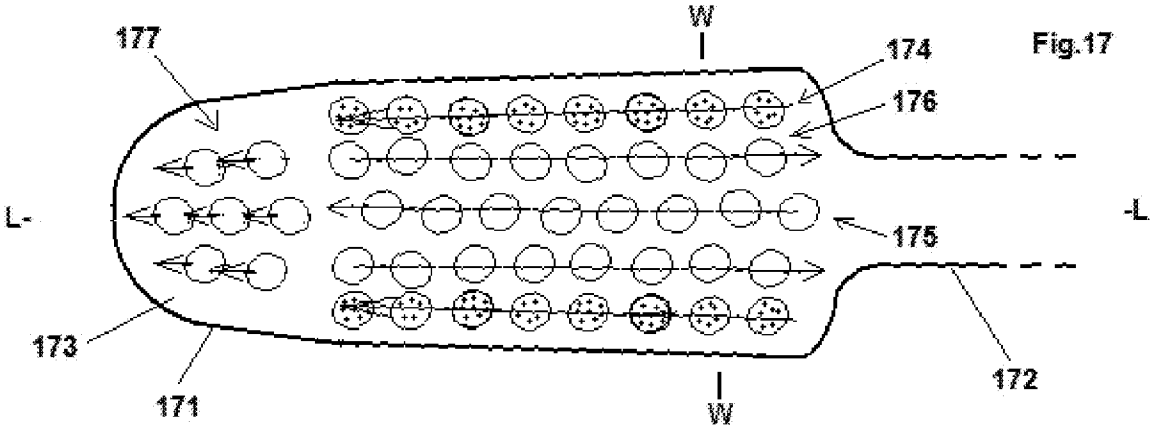
FIG. 17 shows a plan view of a toothbrush head.

For example, referring to FIG. 17 this shows a plan view of a toothbrush head 171 and part of the immediately adjacent neck 172 which connects the head integrally to the grip handle (not shown), looking down on the bristle surface 173 in a direction perpendicular to the longitudinal direction L-L and the width direction W-W. In an arrangement similar to FIG. 16, a pattern of first 174,175 and second 176 tufts extend from the bristle surface 173 in an arrangement analogous to FIG. 16, arrows indicating the respective directions of inclination of the tufts. In FIG. 17 all of the first tufts 174 include tapered bristles and non tapered bristles, and in these tufts 174 the tapered bristles are longer than the non-tapered bristles therein. In the tufts 174, 175, 176 there are tufts which are respectively of greater and lesser length, e.g. analogously to the constructions of FIGS. 12-16 above. In this arrangement the second tufts 176 and a further line of first tufts 175 consist entirely of non-tapered bristles. In this arrangement therefore, only the lines 174 of first tufts which are widthways outermost in the pattern of tufts 174, 175, 176 on the bristle surface 173 include tapered bristles. Analogous to FIG. 13, adjacent the end of the head 171 furthest from the handle 172 is a cluster of tufts 177 of the greater length, which lean in the direction of the first tufts 174, and which comprise only non-tapered bristles.

Typically in FIGS. 12-17 the greater length may be 11-13 mm and the lesser length may be 9-11 mm. For example the tapered bristles may be 1-5 mm, for example 2-4 mm longer than the greater length.

What is claimed is:

1. A toothbrush head, being connected to or connectable to a toothbrush grip handle to thereby define a head-grip handle longitudinal direction, the head being elongate in the longitudinal direction and having a width direction across the head perpendicular to the longitudinal direction, the head having a bristle surface from which inclined plural tufts of bristles extend, the plural bristle tufts comprising;

at least four rows of first tufts arranged in a longitudinal direction along the bristle surface, the at least four rows of tufts having two outer rows of tufts proximate to the periphery of the head and at least two inner rows of tufts within the outer rows of tufts, wherein the outer rows of tufts are inclined in a direction having a longitudinal component at 75-85° to the bristle surface such that the ends of the bristles remote from the bristle surface are longitudinally further from the handle than the ends closest to the bristle surface, and wherein the inner rows of tufts are inclined in a direction having a longitudinal component at 75-85° to the bristle surface such that the ends of the bristles remote from the bristle surface are longitudinally closer to the handle than the ends closest to the bristle surface, wherein the outer rows of tufts comprise tufts containing non-tapered bristles having a first greater length $LN^1$ and tufts of non-tapered bristles having a second lesser length $LN^2$, and the inner rows of tufts comprise tufts containing non-tapered bristles having a first greater length $LN^1$ and tufts of non-tapered bristles having a second lesser length $LN^2$, and wherein in the outer rows of tufts, individual tufts of the first greater length $LN^1$ alternate longitudinally with tufts of the second lesser length $LN^2$, and in the inner rows of tufts individual tufts of the first greater length $LN^1$ alternate longitudinally with tufts of the second lesser length $LN^2$, and wherein at least one tuft in the outer rows of tufts and/or at least one tuft from the inner rows of tufts contains both tapered and non-tapered bristles and all the tapered bristles contained in said tufts have the same length LT greater than the greater length $LN^1$ of the non-tapered bristles.

2. A toothbrush head according to claim 1 wherein the respective greater lengths $LN^1$ are the same.

3. A toothbrush head according to claim 1 wherein the respective lesser lengths $LN^2$ are the same.

4. A toothbrush head according to claim 1 wherein the greater length $LN^1$ of the tufts in the inner and outer rows is the same, and the lesser length $LN^2$ of the tufts in the inner and outer rows is the same.

5. A toothbrush head according to claim 1 wherein the angle of inclination is 78-82° to the bristle surface.

6. A toothbrush provided with a head according to claim 1.

7. A toothbrush head according to claim 1 wherein all the tufts in the inner and outer rows contain tapered bristles of the length LT.

8. A toothbrush head according to claim 1 wherein adjacent the end of the head furthest from the handle neck is a cluster of plural tufts which are inclined in a direction having a longitudinal component at 75-85° to the bristle surface such that the ends of the bristles remote from the bristle surface are longitudinally further from the handle than the ends closest to the bristle surface, and comprise non-tapered tufts having the first greater length $LN^1$ and tapered bristles having the length LT greater than $LN^1$.

9. A toothbrush head being connected to or connectable to a toothbrush grip handle to thereby define a head-grip handle longitudinal direction, the head being elongate in the longitudinal direction and having a periphery and a width direction across the head perpendicular to the longitudinal direction and which has a bristle surface from which at least four rows of plural tufts of bristles extend, the plural bristle tufts comprising;

at least one row of plural first tufts which are inclined in a direction having a longitudinal component at 75-85° to the bristle surface such that the ends of the bristles remote from the bristle surface are longitudinally further from the handle than the ends closest to the bristle surface, at least one row of plural second tufts, widthways distanced from the plural first tufts, the second tufts being inclined in a direction having a longitudinal component at 75-85° to the bristle surface such that the ends of the bristles remote from the bristle surface are longitudinally closer to the handle than the ends closest to the bristle surface, the plural first tufts comprising tufts containing non-tapered bristles having a greater length $LN^1$ and tufts comprising non-tapered bristles having a lesser length $LN^2$, the plural second tufts comprising tufts containing non-tapered bristles having a greater length $LN^1$ and tufts comprising non-tapered bristles having a lesser length $LN^2$, at least one first tuft and/or at least one second tuft also containing tapered bristles, all said tapered bristles having the same length LT greater than the greater length LN1 of the non-tapered bristles, wherein one or more first tufts including non-tapered bristles of the greater length $LN^1$ alternate longitudinally with one or more first tufts including non-tapered bristles of the lesser length $LN^2$;

and wherein one or more second tufts including non-tapered bristles of the greater length $LN^1$ alternate longitudinally with second tufts including non-tapered bristles of the lesser length $LN^2$.

10. A toothbrush head according to claim 9 wherein the respective greater lengths $LN^1$ of non-tapered bristles in first and second tufts is the same.

11. A toothbrush head according to claim 10 wherein the respective lesser lengths $LN^2$ of non-tapered bristles in the first and second tufts is the same.

12. A toothbrush head according to claim 11 wherein individual first tufts including non-tapered bristles of the greater length $LN^1$ alternate longitudinally with individual first tufts including non-tapered bristles of the lesser length $LN^2$.

13. A toothbrush head according to claim 12 wherein individual second tufts including non-tapered bristles of the greater length $LN^1$ alternate longitudinally with individual second tufts including non-tapered bristles of the lesser length $LN^2$.

14. A toothbrush head according to claim 9 wherein individual first tufts including non-tapered bristles of the greater length $LN^1$ or lesser length $LN^2$ alternate longitudinally with two or more first tufts including non-tapered bristles of respectively the lesser or greater length.

15. A toothbrush head according to claim 9 wherein two or more tufts including non-tapered bristles of the greater $LN^1$ or lesser $LN^2$ length alternate longitudinally with two or more tufts including non-tapered bristles of respectively the lesser length $LN^2$ or greater length $LN^1$.

16. A toothbrush provided with a head according to claim 9.

17. A toothbrush head according to claim 9 wherein all the first and second tufts contain tapered bristles of the length LT.

18. A toothbrush head according to claim 9 wherein adjacent the end of the head furthest from the handle neck is a cluster of plural tufts which are inclined in a direction having a longitudinal component at 75-85° to the bristle surface such that the ends of the bristles remote from the bristle surface are longitudinally further from the handle than the ends closest to the bristle surface, and comprise non-tapered tufts having the first greater length $LN^1$ and tapered bristles having the length LT greater than $LN^1$.

* * * * *